US011213146B1

(12) United States Patent
Sletten

(10) Patent No.: US 11,213,146 B1
(45) Date of Patent: Jan. 4, 2022

(54) BEVERAGE CONTAINER SYSTEM

(71) Applicant: Scott Sletten, Sioux Falls, SD (US)

(72) Inventor: Scott Sletten, Sioux Falls, SD (US)

(73) Assignee: JDS Industries, Inc., Sioux Falls, SD (US)

( * ) Notice: Subject to any disclaimer, the term of this patent is extended or adjusted under 35 U.S.C. 154(b) by 0 days.

(21) Appl. No.: 17/223,151

(22) Filed: Apr. 6, 2021

(51) Int. Cl.
*A47G 19/22* (2006.01)
*B65D 47/26* (2006.01)

(52) U.S. Cl.
CPC ..... *A47G 19/2272* (2013.01); *B65D 47/261* (2013.01); *A47G 2200/106* (2013.01)

(58) Field of Classification Search
CPC .... B65D 41/62; B65D 47/261; B65D 47/265; B65D 47/286; A47G 19/2272; A47G 19/2205; A47G 19/2266
USPC ..... 220/230, 713, 252, 254.8, 259.3, 259.4, 220/254.1, 256.1
See application file for complete search history.

(56) References Cited

U.S. PATENT DOCUMENTS 4,643,881 A * 2/1987 Alexander ..... C02F 1/688 116/200
5,449,085 A * 9/1995 Brun, Jr. ..... B65D 47/265 215/309
5,680,951 A * 10/1997 Feltman, III ..... A47G 19/2272 220/253
10,124,942 B2 11/2018 Seiders
10,232,992 B2 3/2019 Seiders
10,232,993 B2 3/2019 Seiders
11,001,422 B2 5/2021 Seiders
11,014,720 B2 5/2021 Seiders
11,021,304 B2 6/2021 Seiders
2007/0012698 A1* 1/2007 Durdon ..... A47G 19/2272 220/253
2007/0029322 A1* 2/2007 Durdon ..... B65D 47/265 220/254.4
2012/0037669 A1* 2/2012 Goetz ..... A47G 19/34 222/456
2013/0062347 A1* 3/2013 Webster ..... G01F 11/46 220/253
2015/0251818 A1* 9/2015 Strachan ..... B65D 47/265 220/254.8
2015/0272359 A1* 10/2015 Oakes ..... B65D 39/00 220/254.1
2016/0176587 A1* 6/2016 Heraud ..... A45D 40/00 220/230

(Continued)

*Primary Examiner* — Robert Poon
(74) *Attorney, Agent, or Firm* — Jeffrey A. Proehl; Woods, Fuller, Schultz & Smith, PC

(57) ABSTRACT

A lid assembly may include a lid member having a base wall with a drinking opening. A top surface of the base wall may include a groove portion forming a groove on the top of the lid member and a central protruding portion located adjacent to the groove portion. A blocking member may removably rest on the top surface of the lid member and be movable in rotational movement between a blocked position characterized by the blocking member blocking the drinking opening and an unblocked position characterized by the blocking member unblocking the drinking opening. Positioning holding structure may be provided to resist movement of the blocking member out of each of the blocked and unblocked positions, and thereby releasably hold the blocking member in each of the blocked and unblocked positions.

20 Claims, 5 Drawing Sheets

(56) References Cited

U.S. PATENT DOCUMENTS

| | | | |
|---|---|---|---|
| 2019/0152661 | A1 | 5/2019 | Seiders |
| 2020/0331671 | A1 | 10/2020 | Seiders |

* cited by examiner

BEVERAGE CONTAINER SYSTEM

BACKGROUND

Field

The present disclosure relates to beverage containers and more particularly pertains to a new beverage container system with the lid assembly for selectively controlling dispensing of liquids from the interior of the system.

SUMMARY

In one aspect, the present disclosure relates to a lid assembly for removably mounting on an open top of a container body. The lid assembly may include a lid member having a top and a bottom and a base wall having a top surface and a bottom surface opposite of the top surface. The base wall may have a drinking opening extending through the base wall from the top surface to the bottom surface such that fluids in an interior of the container body may be drawn through the lid member when the lid member is mounted on the container body. The top surface of the base wall may include a groove portion forming a groove on the top of the lid member and a central protruding portion located adjacent to the groove portion such that the groove extends substantially about the central protruding portion. The lid assembly may also include a blocking member removably restable on the lid member with a lower surface of the blocking member positioned against the top surface of the base wall of the lid member. The blocking member may be movable in rotational movement with respect to the lid between a blocked position and an unblocked position, with the blocked position being characterized by the blocking member blocking the drinking opening of the lid member and the unblocked position being characterized by the blocking member unblocking the drinking opening of the lid member. The lid assembly may further include positioning holding structure provided to resist movement of the blocking member out of each of the blocked and unblocked positions, and thereby releasably hold the blocking member in the blocked position or the unblocked position. The position holding structure may have elements on the lid member and elements on the blocking member which cooperate to produce the holding of the blocked and unblocked positions of the member.

In one aspect, the present disclosure relates to a beverage container system comprising a container body having an interior and an open top which opens into the interior, with the open top being defined by an upper edge, and a lid assembly removably mounted on the open top of the container body. The system may further comprise a lid assembly including a lid member having a top and a bottom, and a base wall having a top surface and a bottom surface opposite of the top surface. The base wall may have a drinking opening extending through the base wall from the top surface to the bottom surface such that fluids in an interior of the container body may be drawn through the lid member when the lid member is mounted on the container body. The top surface of the base wall will a groove portion forming a groove on the top of the lid member, and a central protruding portion located adjacent to the groove portion such that the groove extends substantially about the central protruding portion. The lid assembly may further include a blocking member removably restable on the lid member with a lower surface of the blocking member positioned against the top surface of the base wall of the lid member. The blocking member may be movable in rotational movement with respect to the lid between a blocked position and an unblocked position, with the blocked position being characterized by the blocking member blocking the drinking opening of the lid member, the unblocked position being characterized by the blocking member unblocking the drinking opening of the lid member. The lid assembly may also include positioning holding structure provided to resist movement of the blocking member out of each of the blocked and unblocked positions, and thereby releasably hold the blocking member in the blocked position or the unblocked position. The position holding structure may have elements on the lid member and elements on the blocking member which cooperate to produce the holding of the blocked and unblocked positions of the member.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of the steps set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
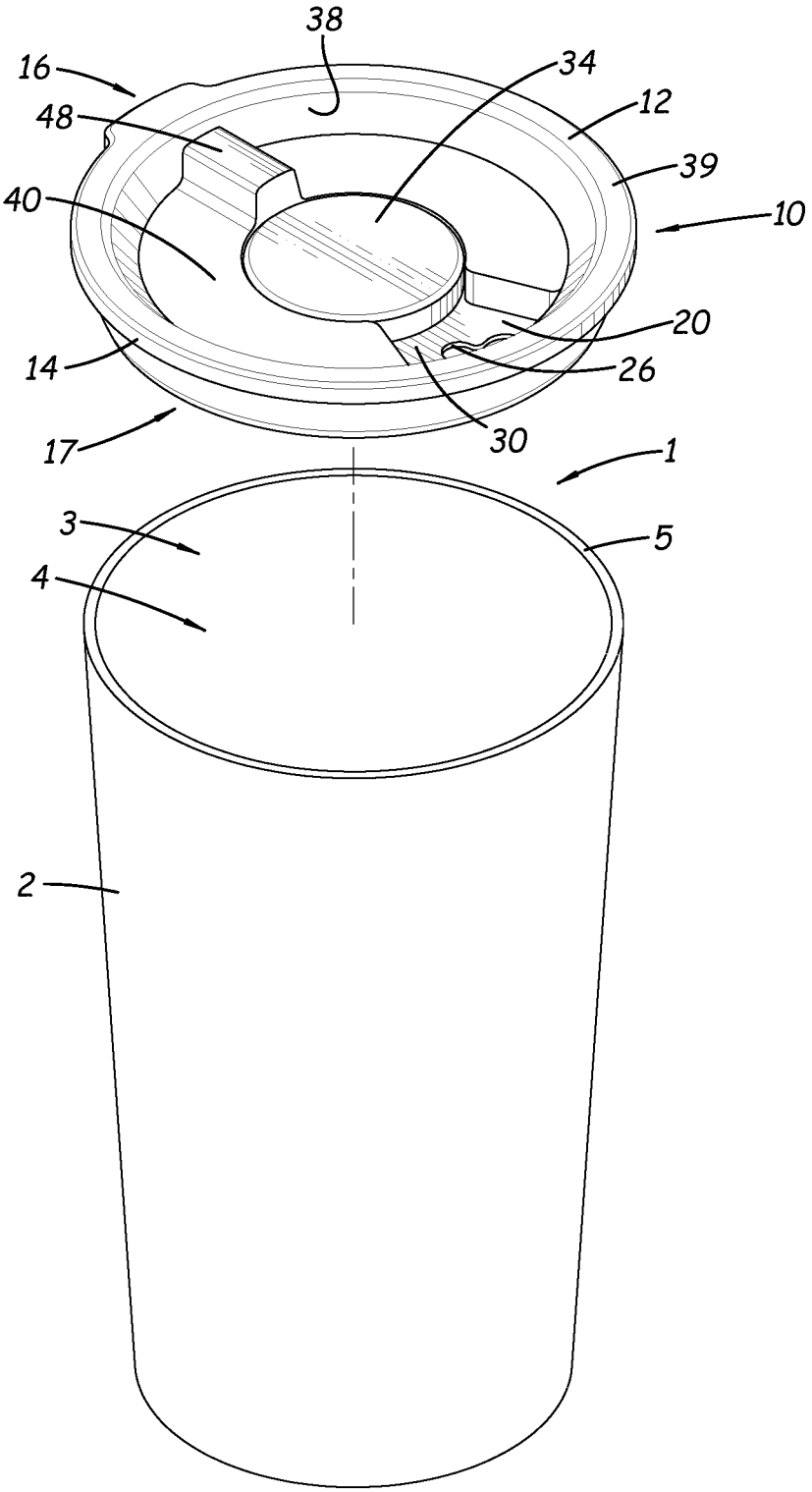
FIG. 1 is a schematic perspective view of a new beverage container system according to the present disclosure in an exploded condition.
Figure 2:
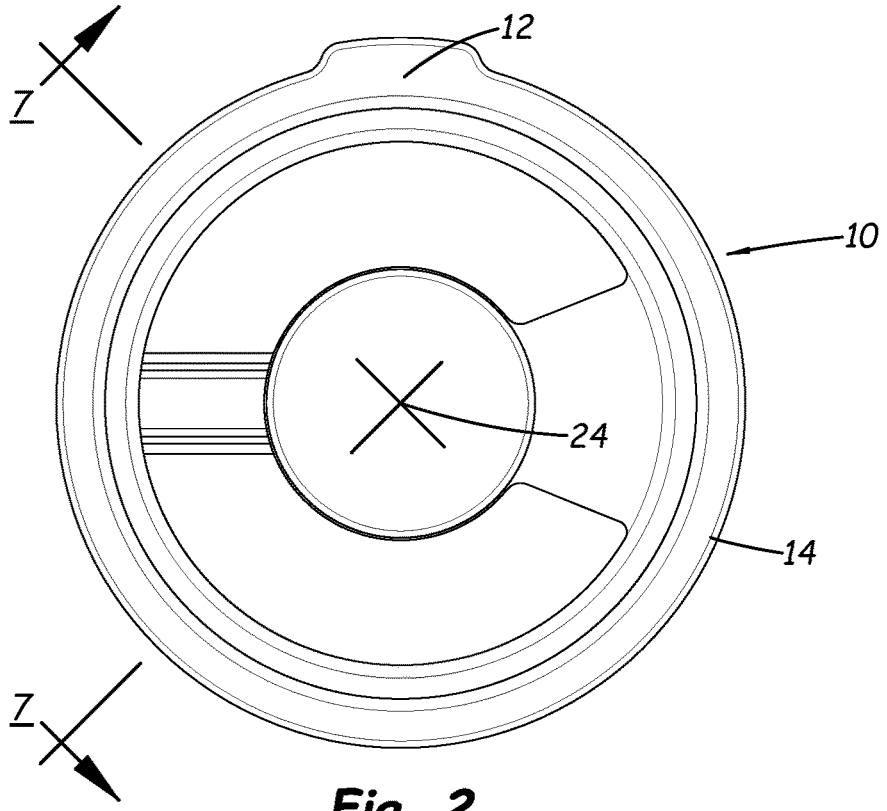
FIG. 2 is a schematic top view of the lid assembly of the system, according to an illustrative embodiment, showing the blocking member in a blocked condition.
Figure 3:
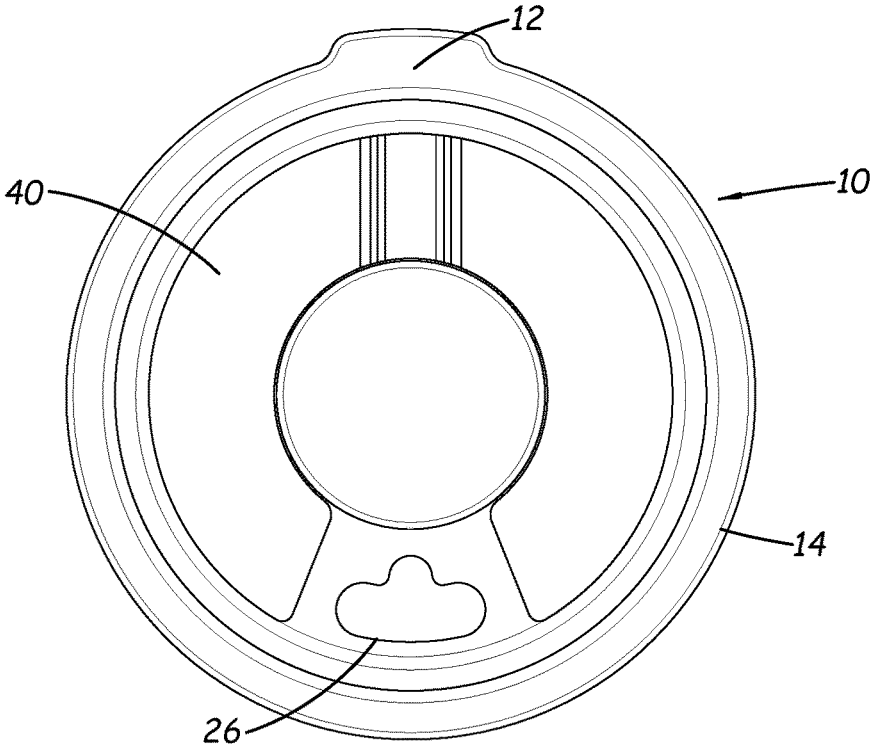
FIG. 3 is a schematic top view of the lid assembly of the system, according to an illustrative embodiment, showing the blocking member in an unblocked condition.
Figure 4:
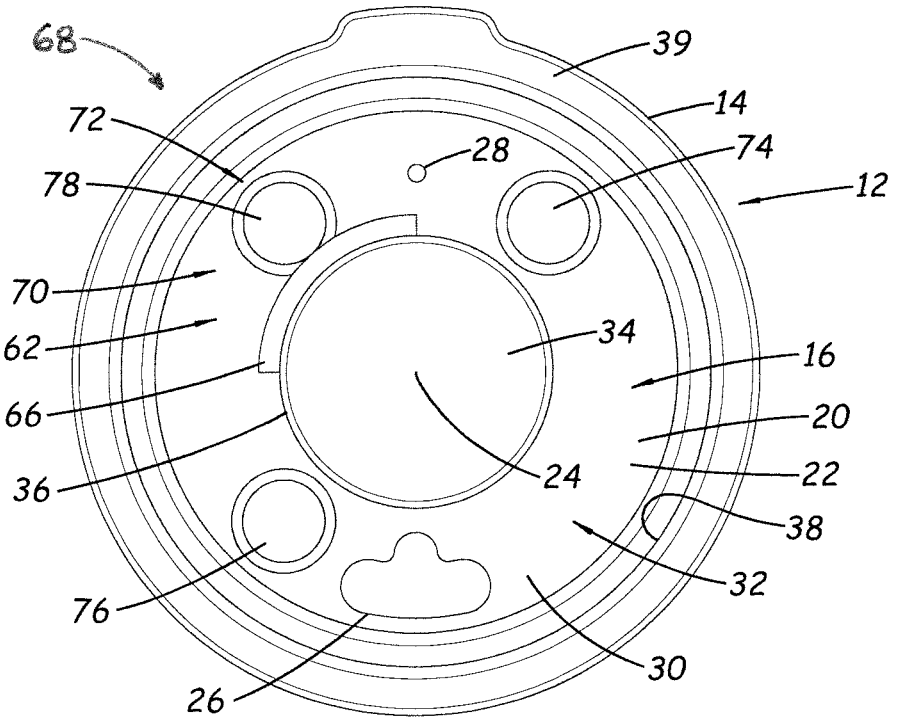
FIG. 4 is a schematic top view of the lid member of the lid assembly isolated from the blocking member of the lid assembly, according to an illustrative embodiment.
Figure 5:
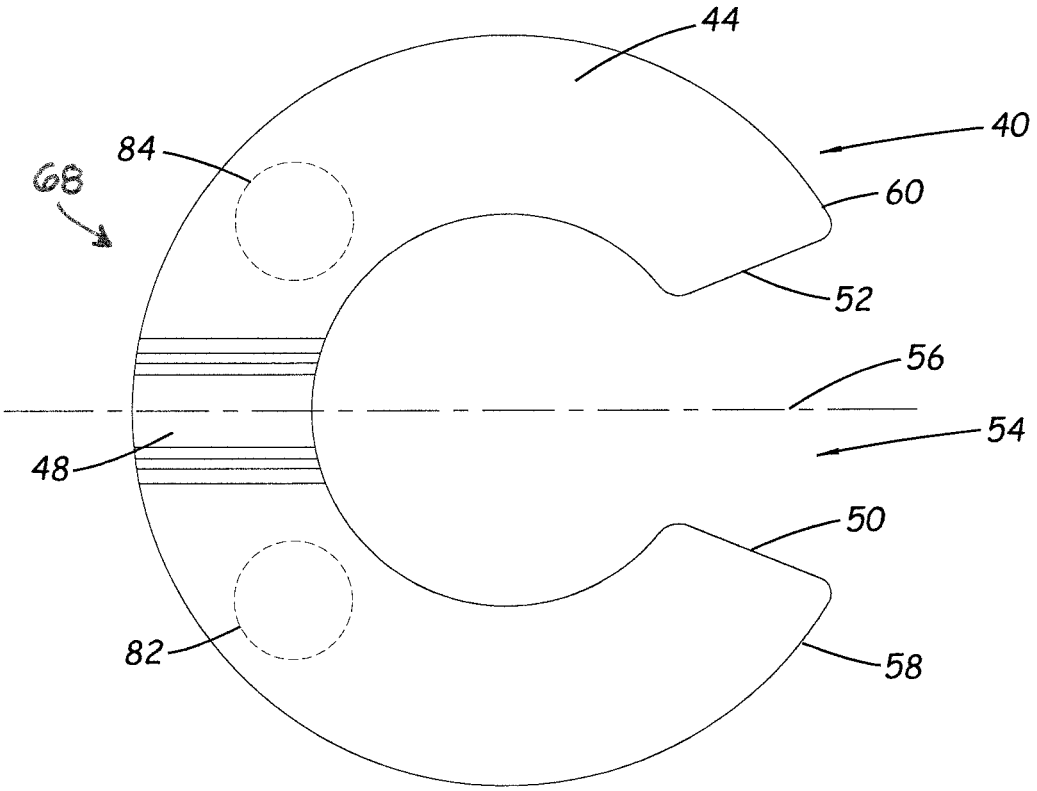
FIG. 5 is a schematic top view of the blocking member of the lid assembly isolated from the lid member of the lid assembly, according to an illustrative embodiment.
Figure 6:
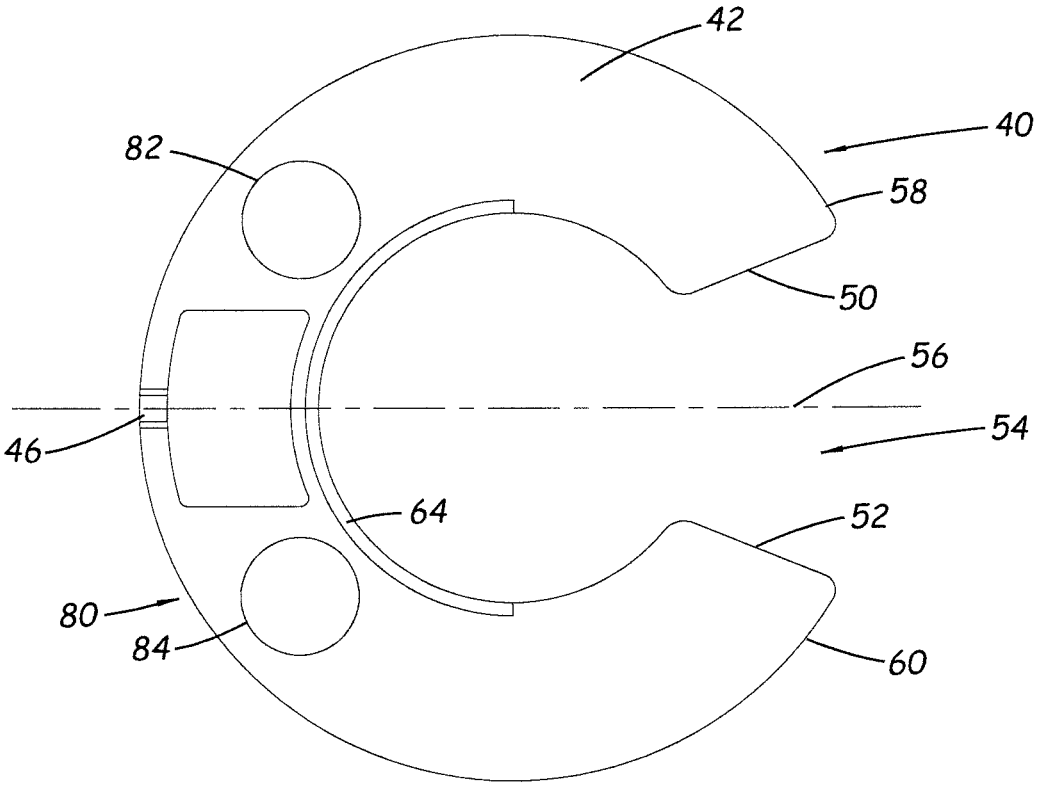
FIG. 6 is a schematic bottom view of the blocking member of the lid assembly isolated from the lid member of the lid assembly, according to an illustrative embodiment.
Figure 7:
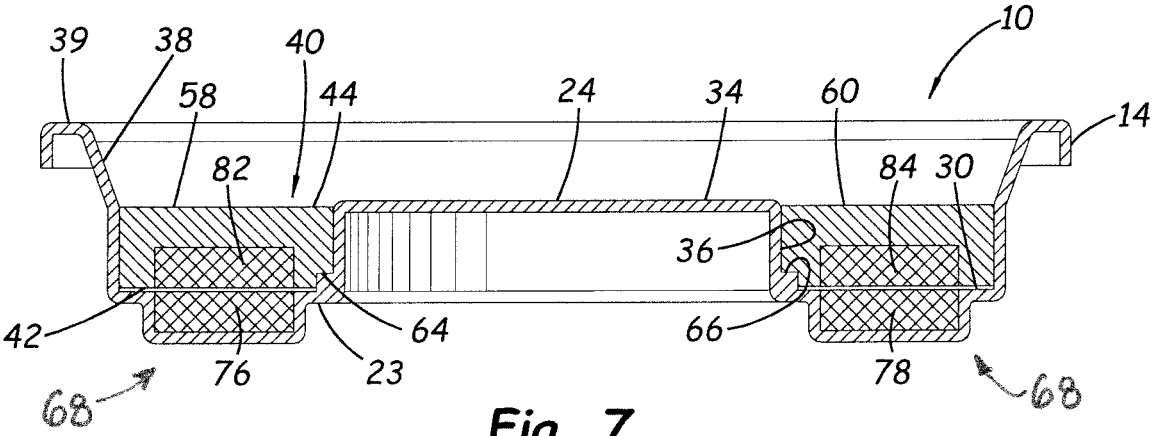
FIG. 7 is a schematic sectional view of the lid assembly, according to an illustrative embodiment, shown in the blocked condition and taken along line 7-7 shown in FIG. 2.
Figure 8:
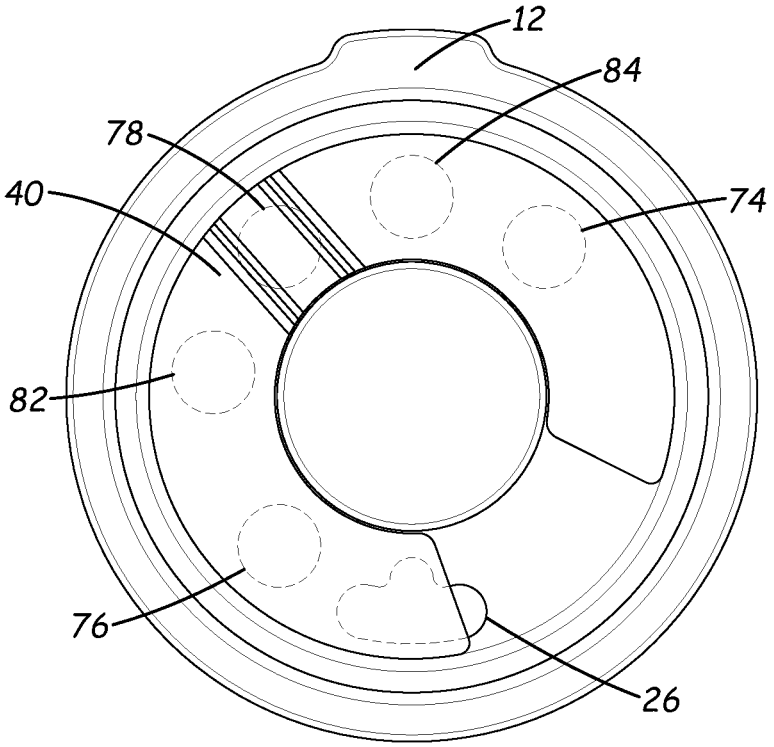
FIG. 8 is a schematic top view of the lid assembly, according to an illustrative embodiment, shown in a release position located between the blocked and unblocked positions.

With reference now to the drawings, and in particular to FIGS. 1 through 8 thereof, a new beverage container system embodying the principles and concepts of the disclosed subject matter will be described.

Beverage containers are often provided with lids as a means for avoiding spillage of the contents, and also as a means for maintaining the temperature of the beverage contained therein. Providing the lids with a small opening provides convenient drinking of the liquid without removing the lid for each sip. Mechanisms capable of selectively closing the small opening in the lid help to maintain the functionality of the lid in protecting against spills and maintaining the temperature of the beverage when the user is not actively drinking from the beverage container.

The capability to clean the container, the lid, and in particular the mechanism for closing the drinking opening, is highly desirable, and typically an effective cleaning requires some degree of disassembly of the lid and/or closing mechanism.

However, the applicants have recognized that due to the proximity to the user's mouth to the lid, and in particular to the closing mechanism, during use of the beverage container have the potential to pose a choking hazard if parts of the lid or mechanism become dislodged from other parts of the container or lid.

Such dangers may be enhanced by the use of small parts in the closing mechanism, such as parts of a size and shape small enough to easily pass between the user's lips. Thus, while the use of magnetic attraction tends to facilitate easy disassembly of the lid and closure mechanism for cleaning, the lack of a mechanical connection between the parts of the closure mechanism and the lid may make unintentional dislodgement of parts from each other during periods of use of the beverage container more likely.

The applicants have developed a system with means for selectively blocking the drinking opening in the lid that utilizes magnetic attraction to hold the blocking element in blocked and unblocked positions, and when the blocking mechanism is moved between the blocked and unblocked positions and the beverage container is not proximate to the user's mouth, using mechanical cooperation and gravity to hold the blocking mechanism on the lid. The relatively large size of the blocking mechanism, which may be almost as large as the in diameter of the lid, as well as an irregular shape which may resemble a hook, make unintentional movement of the blocking mechanism into the mouth highly unlikely.

In one aspect, the disclosure relates to a beverage container system 1 particularly suitable for holding liquids to be consumed by the user of the system 1. In broader aspects, the beverage container system 1 may include a container body 2 that has an interior 3 and an open top 4 which opens into the interior to permit fluids to be put into, and removed from, the interior 3. The open top 4 may be defined by an upper edge 5 which may be generally circular. In some embodiments, the perimeter wall of the body 2 may have a double thickness with a vacuum therebetween to enhance the insulating ability of the wall.

The disclosure also relates to a lid assembly 10, either alone or in combination with the container body 2, as a closure for the open top 4 of the container body 2 in order to retain the contents of the body 2 in the interior 3. The lid assembly 10 may be removably mounted on the container body 2 to facilitate filling of the interior 3, as well as cleaning of the interior 3 as well as elements of the lid assembly. The lid assembly 10 may generally include a lid member 12 and a blocking member 40 utilized to selectively block one or more openings in the lid member.

The lid member 12 has a mounted condition, and a dismounted condition (see FIG. 1), with respect to the body 2. The lid member 12 may generally have a perimeter 14 which is sized and shaped to closely fit the open top 4 of the body 2 and provide a fluid tight relationship therebetween in the mounted condition. Optionally, a gasket structure may be provided along the perimeter 14 to enhance the fluid tight relationship between the perimeter of the lid member and the open top 4 of the body 2 in the mounted condition. The lid member 12 also has a top 16 and a bottom 17, and the bottom is normally oriented toward the interior 3 of the container body when the lid member is in the mounted condition, while the top is normally oriented away from the interior when the lid member is in the mounted condition.

In greater detail, the lid member 12 may comprise a base wall 20 which is generally positionable across the interior 3 adjacent to the open top 4 of the container body 2 when the lid member 12 is in the mounted condition. The base wall 20 may have a top surface 22 oriented toward the top 16 of the lid member 12 such that the top surface is oriented away from the interior 3 in the mounted condition. Generally opposite of the top surface 22 on the base wall 20 is a bottom surface 23 which is oriented toward the interior 3 of the container body in the mounted condition of the lid assembly. The base wall 20 has a center point 24 which may be located at the center of a circle defined by the perimeter 14. The base wall 20 may also have a drinking opening 26 through which fluids in the interior 3 of the body may be drawn (and thus withdrawn from the interior 3) when the lid member is in the mounted condition. The drinking opening 26 extends through the base wall 20 from the top surface 22 to the bottom surface 24 of the wall 20. When the top 16 of the lid member 12 is viewed from above, the drinking opening 26 may be located at approximately a six o'clock position on the base wall 20 when a clock face is used as a positional reference. The base wall may also include a vent opening 28 which extends from the top surface 22 to the bottom surface 23 to permit a fluid such as air to pass through the lid member 12 when the user is drawing fluid through the drinking opening 26. The vent opening 28 may be located on the base wall 20 at a location generally opposite of the drinking opening 26, such as at a twelve o'clock position in opposition to the six o'clock position of the opening 26.

The top surface 22 of the base wall 20 may include a groove portion 30 forming a groove 32 on the top of the lid member. The groove 32 may be substantially annular about the center point 24 of the base wall, and endless in character. The groove portion 20 of the top surface may be substantially planar in contour, and the drinking opening 26 may be located in the groove portion. The top surface 22 of the base wall 20 may also include a central protruding portion 34 located adjacent to the groove portion 30, and may protrude with respect to the plane of the groove portion. The groove 32 may extend about the central protruding portion 34 such that the protruding portion is surrounded by the groove, and may also be surrounded by the groove portion. The central protruding portion 34 may be substantially centered on the center point 24 of the base wall, although other positionings may be utilized. The central protruding portion 34 of the top surface 22 may be substantially planar in contour, but may include variations in the surface including, for example, an embossed logo. The depth of the groove 32 may be measured between a plane defined by the groove portion 30 of the surface 22 and a plane defined by the central protruding portion 34 of the surface 22.

The top surface 22 may further include a peripheral portion 36 that extends between the groove portion 30 and the central protruding portion 34 of the top surface 22 of the base wall. Illustrative, the peripheral portion 36 may be substantially cylindrical in shape.

The lid member 12 may also include a perimeter wall 38 extending along the perimeter 14 of the lid member. The perimeter wall 38 may extend upwardly from the base wall 20 in the top direction. The perimeter wall 38 may be oriented generally perpendicular to the general plane of the base wall. The groove portion 30 may extend from the perimeter wall 38 to the central protruding portion 34, or the peripheral portion 36 if present, of the top surface 22. The lid member 38 may also include a perimeter lip 39 for resting on the upper edge 5 of the container body 2 when the lid member is in the mounted condition on the container body. The perimeter lip 39 may extend along the perimeter 14 of the lid member, and may extend radially outwardly from the perimeter wall 38. The perimeter wall 38 may extend between the perimeter lip 39 and the base wall 20 in a manner that offsets the perimeter lip from the top surface 22 of the base wall.

Typically, the base wall 20, the perimeter wall 38, and the perimeter lip 39 are unitary and molded out of a single piece of material, such as, for example, a transparent or translucent plastic but other configurations and materials may be utilized.

The blocking member 40 may be restable upon the top surface 22 of the lid member and may be movable relative to the lid member 10. The blocking member 40 may be movable between a blocked condition and an unblocked condition with respect to the lid member. The blocked condition of the blocking member 40 (see FIG. 2) may correspond to a blocked position for the blocking member which is characterized by the blocking member blocking the drinking opening of the lid member, and may do so in a substantially fluid tight manner. The unblocked condition (see FIG. 3) may correspond to an unblocked position for the blocking member which is characterized by the blocking member 40 unblocking the drinking opening 26 of the lid to permit the passage of fluid through the opening 26. The blocking member 40 may have a lower surface 42 for positioning against the top surface 22 of the base wall of the lid member, as well is adjacent to the drinking opening 26 when in the blocked condition, and may have an upper surface 44 opposite of the lower surface.

The lower surface 42 of the blocking member may have a vent channel 46 configured and positioned on the blocking member to permit gas to pass from the vent opening 28 past the blocking member. The vent channel 46 may be generally positioned at a medial location on the lower surface 42 of the blocking member which is alignable with the vent opening 28 when the blocking member is in the unblocked condition. In some embodiments, the vent channel 46 may originate from a cavity extending into the blocking member from the lower surface 42 toward the upper surface 44, and radiate outwardly to an edge of the blocking member. When the vent channel 46 and the vent opening 28 are not aligned, such as in the blocked condition of the blocking member, blocked condition of the blocking member movement of gas through the vent opening may be impeded or substantially prevented by the lower surface 42 of the blocking member. A grip 48 may be formed on the upper surface 44 of the blocking member for being gripped by fingers of the user to facilitate movement of the blocking member between the unblocked and blocked positions. The blocking member 40 may have a thickness between the upper 44 and lower 42 surfaces, and the thickness may be substantially equal to the depth of the groove 32 of the lid member.

In some embodiments, movement of the blocking member 40 between the positions associated with the blocked and unblocked conditions may be rotational movement. The blocking member 40 may be spaced from the center point 24 such that the member 40 rotates about the point 24 rather than rotating one the point 24. The blocking member 40 may be removably positioned in the groove 32 of the top surface of the base wall such that the groove provides a substantial degree of guidance to the movement of the blocking members between the positions. In some embodiments, the blocking member 40 may rotate approximately 90° about the center point 24 in movement between the blocked and unblocked positions.

The blocking member 40 may be incompletely circular, and may extend partially about the central protruding portion 34 of the top surface of the base wall in the positions corresponding to the blocked and unblocked conditions, as well as points on the movement path of the member 40 in between the blocked and unblocked positions. In greater detail, the blocking member 40 may have a pair of free ends 50, 52 which define a gap 54 therebetween, and the gap may be located over the drinking opening 26 when the member 40 is in the unblocked condition. Illustratively, the blocking member 40 may have a "C" shape. An axis of symmetry 56 may bisect the blocking member 40 into two sections 58, 60 which may have substantially identical configurations. A first one 58 of the sections of the blocking member 40 may be positioned over the drinking opening 26 in the blocked condition, and may be withdrawn from blocking the drinking opening in the unblocked condition.

Rotation limiting structure 62 may be provided on the lid assembly 10 for limiting the rotational movement of the blocking member 40 with respect to the lid member and effectively define the blocked and unblocked positions of the member 40 at opposite ends of the movement path of the member 40. The rotation limiting structure 62 may include elements on the lid member 12 and the blocking member 40 which mechanically cooperate to produce the rotation limitation. In the illustrative embodiments, the rotation limiting structure 62 may comprise a slot 64, and a ridge 66 which is positionable in the slot. The slot 64 may have an extent or length which is longer than an extent or length of the ridge 66 so that the ridge is movable along the slot. In the illustrative embodiments, the slot 64 may be formed in the blocking member 40 and the ridge 66 may be formed on the lid member 12. The slot 64 may be arcuate in shape, and the ridge 66 may also be arcuate in shape to facilitate movement of the ridge along the slot. Illustratively, the slot 64 may extend along an arc of approximately 180 degrees, and the ridge 66 may extend along an arc of approximately 90 degrees to permit approximately 90 degrees of movement of the ridge with respect to the slot, and thus approximately 90 degrees of movement of the blocking member with respect to the lid member.

The lid assembly 10 may further include position holding structure 68 provided to resist movement of the blocking member 40 out of the blocked position of the blocked condition, and out of the unblocked position of the unblocked condition, and thereby releasably hold the blocking member in the blocked position when the blocking member is in the blocked position, or in the unblocked position when the blocking member is in the unblocked position.

The position holding structure 68 may include elements of the lid member 12 and the blocking member 40 which cooperate to produce the holding of the blocked and unblocked positions of the member 40.

The position maintaining structure 68 of the lid assembly 10 may include a plurality of holding magnets 70 for holding the blocking member 40 at end points of the movement of the blocking member with respect to the lid member. The plurality of holding magnets 70 may be mounted on the blocking member 40 and the lid member 12. In some embodiments, the holding magnets 70 on the blocking member may be inset into the member 40 such that the magnets 70 are substantially flush with the lower surface 42 of the member 40, and the holding magnets 70 on the lid member 12 may be inset into the base wall 20 such that the magnets 70 are substantially flush with the groove portion 30 of the top surface 22 of the lid portion 12.

The plurality of holding magnets 70 may include a first set 72 of holding magnets which are integrated with the lid member 12, and may be positioned at the groove portion 30 of the upper surface of the lid member of the movement path of the blocking member 40. The plurality of holding magnets 70 may further include a second set 80 of holding magnets which are integrated with the blocking member 40.

In some embodiments, the first set 72 of holding magnets may include an unblocked condition holding magnet 74 for assisting in the holding of the blocking member in the unblocked condition, and the unblocked condition holding magnet may be configured to magnetically attract one magnet of the second set of holding magnets when the blocking member is in the unblocked position. Illustratively, the unblocked condition holding magnet 74 is located at approximately a seven o'clock to an eight o'clock position on the base wall 20 when the lid member is viewed from the top and the drinking opening 26 is in the six o'clock position.

In embodiments, the holding magnets 70 may also include a blocked condition holding magnet 76 for assisting in the holding of the blocking member in the blocked condition, and the blocked condition holding magnet may be configured to magnetically attract one magnet of the second set of holding magnets when the blocking member is in the blocked position. The blocked condition holding magnet 76 may be spaced from the unblocked condition holding magnet 74. In some embodiments, the location of the blocked condition holding magnet 76 may be spaced approximately 180 degrees about the center point 24 from the location of the unblocked condition holding magnet 74. Illustratively, the blocked condition holding magnet 76 may be located at approximately a one o'clock to a two o'clock position on the base wall 20 when the lid member is viewed from above the top and the drinking opening 26 is in the six o'clock position.

The holding magnets 70 may also include an intermediate holding magnet 78. In some embodiments, the intermediate holding magnet may be configured to magnetically attract one magnet of the second set of holding magnets when the blocking member 40 is in the unblocked position and magnetically attract another magnet of the second set of holding magnets when the blocking member is in the blocked position. Illustratively, the intermediate holding magnet 78 may be located at approximately a ten o'clock to an eleven o'clock position on the base wall 20 when the lid member is viewed from the top and the drinking opening 26 is in the six o'clock position.

The second set 80 of holding magnets may include a first alignment magnet 82 located on the first section 58 of the blocking member, such as at a position generally closer to the axis 56 of symmetry than toward the first free end 50. In some embodiments, the first alignment magnet 82 may be aligned with the intermediate holding magnet 78 when the blocking member 40 is in the unblocked condition, and illustratively, the first alignment magnet 82 may be located directly above the intermediate holding magnet 78. Further, in some embodiments, the first alignment magnet 82 may be aligned with the blocked condition holding magnet 76 when the blocking member 40 is in the blocked condition, and illustratively, the first alignment magnet 82 may be located directly above the blocked condition holding magnet 76.

The second set 80 of holding magnets may also include a second alignment magnet 84 located on the second section 60 of the blocking member, such as at a position generally closer to the axis of symmetry than toward the second free end 52. In some embodiments, the second alignment magnet 84 may being aligned with the intermediate holding magnet 78 when the blocking member 40 is in the blocked condition, and illustratively, the second alignment magnet 84 may be located directly above the intermediate holding magnet 78. Further, in some embodiments, the second alignment magnet 84 may be aligned with the unblocked condition holding magnet 74 when the blocking member 40 is in the unblocked condition, and illustratively, the second alignment magnet 84 may be located directly above the unblocked condition holding magnet 74.

The alignment magnets 82, 84 may each be in magnetic communication with an individual one of the holding magnets in each of the unblocked and blocked conditions, while the specific holding magnets with which the alignment magnets are in magnetic communication is different in the unblocked and blocked conditions. The intermediate holding magnet 78 may thus be in effective magnetic communication with one of the alignment magnets 82, 84 in each of the unblocked and blocked conditions, but the particular alignment magnet with which the magnet 78 is in communication is different depending upon whether the blocking member is in the blocked position over the unblocked position Advantageously, the configuration of the holding magnets 70 permits, when the top 16 of the lid member 12 is oriented in an upward direction, gravity to maintain the blocking member 40 in contact with the lid member when the member 40 is in between the blocked and unblocked positions, such as, for example, while the blocking member is being moved from one of the positions to the other of the positions.

As the blocking member 40 moves relative to the lid member 12 from one position to the other position, and the alignment magnets 80 on the blocking member move out of alignment with the holding magnets 70 on the lid member, the ability of the alignment and positioning magnets to attract each other diminishes to a minimal (if not nonexistent) level in which the magnets are unable to maintain the blocking member in contact with the lid member independent of the influence of gravity on the blocking member.

Consequently, in at least some implementations, the blocking member 40 may be moved to a release position (see, e.g., FIG. 8) between the unblocked and blocked positions in which the magnetic attraction of the alignment and holding magnets is minimal and unable to cause movement of the blocking member to either the blocked position or the unblocked position from the release position. Illustratively, the release position may be approximately halfway between the blocked and unblocked positions of the blocking member, and may extend to some degree from the halfway or midpoint toward the blocked position and the unblocked position. In such embodiments, the blocking member 40 may need to be moved by the force of the user's finger applied to the member 40 in order to continue movement beyond the release position toward the position to which the blocking member is being moved so that the magnetic attraction between the holding 70 and alignment 80 magnets resumes.

Thus, when the lid assembly 10 is flipped over and the top 16 of the lid member 12 is oriented downwardly so that the lid member is positioned over the blocking member 40, movement of the member 40 to the release position decreases the magnetic attraction between the holding 70 and alignment 80 magnets and may permit gravity to overcome any residual magnetic attraction between the holding and alignment magnets which in turn can cause gravity to remove or release the blocking member 40 from contact with the lid member 12 as the blocking member falls away from the lid member. Thus, inversion of the lid assembly 10 and movement of the blocking member 42 the release position may provide a convenient technique for separating the blocking member from the lid member for various purposes such as cleaning the blocking and lid members individually without requiring the user to pry the blocking member away from the lid member using, for example, the user's finger nail.

Correct reassembly of the lid assembly 10 may be simplified by the inability of the rotation limiting structure 62 and the position holding structure 68 to reengage both mechanically and magnetically unless user correctly positions the blocking member 40 in the groove 32 of the lid member.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A lid assembly for removably mounting on an open top of a container body, the lid assembly including:

a lid member having a top and a bottom, the lid member including a base wall having a top surface and a bottom surface opposite of the top surface, the base wall having a drinking opening extending through the base wall from the top surface to the bottom surface such that fluids in an interior of the container body may be drawn through the lid member when the lid member is mounted on the container body, the top surface of the base wall including:

a groove portion forming a groove on the top of the lid member; and a central protruding portion located adjacent to the groove portion such that the groove extends substantially about the central protruding portion;

a blocking member removably restable on the lid member with a lower surface of the blocking member positioned against the top surface of the base wall of the lid member, the blocking member being movable in rotational movement with respect to the lid along an arcuate movement path along the groove between a blocked position and an unblocked position, the blocking member blocking the drinking opening of the lid member in the blocked position, the blocking member unblocking the drinking opening of the lid member in the unblocked position;

positioning holding structure provided to resist movement of the blocking member out of each of the blocked and unblocked positions, and thereby releasably hold the blocking member in the blocked position or the unblocked position, the position holding structure having elements on the lid member and elements on the blocking member which cooperate to produce holding of the blocked and unblocked positions of the member; and wherein the position holding structure comprises a plurality of holding magnets mounted on the blocking member and a plurality of holding magnets mounted on the lid member, the plurality of holding magnets on the blocking member being located on the blocking member and the plurality of holding magnets on the lid member being located on the lid member in locations configured to hold the blocking member at end points of the movement path on the lid member and resist movement of the blocking member away from the end points of the movement path on the lid member.

2. The assembly of claim 1 wherein the blocking member extends about the central protruding portion when resting in the groove of the groove portion on the lid member.

3. The assembly of claim 1 wherein the plurality of holding magnets includes:

a first set of holding magnets integrated with the lid member, the first set of holding magnets being positioned at the groove portion of the upper surface of the lid member; and a second set of holding magnets integrated with the blocking member.

4. The assembly of claim 3 wherein the first set of holding magnets includes:

an unblocked condition holding magnet configured to magnetically attract one magnet of the second set of holding magnets when the blocking member is in the unblocked position;

a blocked condition holding magnet configured to magnetically attract another magnet of the second set of holding magnets when the blocking member is in the blocked position; and an intermediate holding magnet configured to magnetically attract one magnet of the second set of holding magnets when the blocking member is in the unblocked position and magnetically attract another magnet of the second set of holding magnets when the blocking member is in the blocked position.

5. The assembly of claim 4 wherein the blocked condition holding magnet is spaced from the unblocked condition holding magnet approximately 180 degrees about a center point of the base wall of the lid member.

6. The assembly of claim 4 wherein the second set of holding magnets includes:

a first alignment magnet being aligned with the intermediate holding magnet when the blocking member is in the blocked condition and being aligned with the unblocked condition holding magnet when the blocking member is in the unblocked condition; and a second alignment magnet being aligned with the blocked condition holding magnet when the blocking member is in the blocked condition and being aligned with the intermediate holding magnet when the blocking member is in the unblocked condition.

7. The assembly of claim 1 wherein, when the lid member is oriented with the top upward, gravity maintains the blocking member in contact with the lid member while the blocking member is moved from a first one of the blocked or unblocked conditions to a second one of the blocked or unblocked conditions.

8. The assembly of claim 7 wherein, when the lid member is oriented with the top downward, gravity tends to remove the blocking member from contact with the lid member while the blocking member is moved from the first one of the blocked or unblocked conditions to the second one of the blocked or unblocked conditions.

9. The assembly of claim 3 wherein, when the lid member is oriented with the top upward, gravity maintains the blocking member in contact with the lid member while the blocking member is moved from a first one of the blocked or unblocked conditions to a second one of the blocked or unblocked conditions and the first set of holding magnets are moved out of alignment with the second set of holding magnets.

10. The assembly of claim 9 wherein, when the lid member is oriented with the top downward, gravity tends to remove the blocking member from contact with the lid member while the blocking member is moved from the first one of the blocked or unblocked conditions to the second one of the blocked or unblocked conditions and the first set of holding magnets are moved out of alignment with the second set of holding magnets.

11. The assembly of claim 1 additionally comprising rotation limiting structure for limiting the rotational movement of the blocking member with respect to the lid member, the rotation limiting structure being on the lid member and the blocking member.

12. The assembly of claim 11 wherein the rotation limiting structure comprises a slot formed on one member of the lid and blocking members and a ridge formed on another member of the lid and blocking members, the ridge being positionable in the slot and being movable along the slot, the slot having an extent longer than an extent of the ridge such that the ridge is movable along the slot.

13. The assembly of claim 1 wherein the base wall has a vent opening extending through the base wall from the top surface to the bottom surface of the base wall; and wherein the lower surface of the blocking member has a vent channel configured on the blocking member to align with the vent opening in the base wall of the lid member when the blocking member is in the unblocked condition.

14. The assembly of claim 1 wherein the blocking member is incompletely circular and has a pair of free ends defining a gap therebetween.

15. The assembly of claim 4 wherein the drinking opening is located at approximately a six o'clock position on the base wall when the top surface of the base wall is on top and the lid member is viewed from the top; and wherein the unblocked condition holding magnet is located at approximately a seven o'clock to an eight o'clock position on the base wall when the lid member is viewed from above the top of the lid member;

wherein the blocked condition holding magnet is located at approximately a one o'clock to a two o'clock position on the base wall and the lid member is viewed from above the top of the lid member; and wherein the intermediate holding magnet is located at approximately a ten o'clock to an eleven o'clock position the on the base wall member is viewed from above the top of the lid member.

16. A beverage container system comprising:

a container body having an interior and an open top which opens into the interior, the open top being defined by an upper edge; and a lid assembly removably mounted on the open top of the container body, the lid assembly including:

a lid member having a top and a bottom, the lid member including a base wall having a top surface and a bottom surface opposite of the top surface, the base wall having a drinking opening extending through the base wall from the top surface to the bottom surface such that fluids in an interior of the container body may be drawn through the lid member when the lid member is mounted on the container body, the top surface of the base wall including:

a groove portion forming a groove on the top of the lid member; and a central protruding portion located adjacent to the groove portion such that the groove extends substantially about the central protruding portion;

a blocking member removably restable on the lid member with a lower surface of the blocking member positioned against the top surface of the base wall of the lid member, the blocking member being movable in rotational movement with respect to the lid along an arcuate movement path along the groove between a blocked position and an unblocked position, the blocking member blocking the drinking opening of the lid member in the blocked position, the blocking member unblocking the drinking opening of the lid member in the unblocked position;

positioning holding structure provided to resist movement of the blocking member out of each of the blocked and unblocked positions, and thereby releasably hold the blocking member in the blocked position or the unblocked position, the position holding structure having elements on the lid member and elements on the blocking member which cooperate to produce holding of the blocked and unblocked positions of the member; and wherein the position holding structure comprises a plurality of holding magnets mounted on the blocking member and a plurality of holding magnets mounted on the lid member, the plurality of holding magnets on the blocking member being located on the blocking member and the plurality of holding magnets on the lid member being located on the lid member in locations configured to hold the blocking member at end points of the movement path on the lid member and resist movement of the blocking member away from the end points of the movement path on the lid member.

17. The system of claim 16 wherein the blocking member extends about the central protruding portion when resting in the groove of the groove portion on the lid member.

18. The system of claim 16 wherein the plurality of holding magnets includes:

a first set of holding magnets integrated with the lid member, the first set of holding magnets being positioned at the groove portion of the upper surface of the lid member; and a second set of holding magnets integrated with the blocking member.

19. The system of claim 18 wherein the first set of holding magnets includes:

an unblocked condition holding magnet configured to magnetically attract one magnet of the second set of holding magnets when the blocking member is in the unblocked position;

a blocked condition holding magnet configured to magnetically attract another magnet of the second set of holding magnets when the blocking member is in the blocked position; and an intermediate holding magnet configured to magnetically attract one magnet of the second set of holding magnets when the blocking member is in the unblocked position and magnetically attract another magnet of the second set of holding magnets when the blocking member is in the blocked position.

20. The system of claim 19 wherein the second set of holding magnets includes:

a first alignment magnet being aligned with the intermediate holding magnet when the blocking member is in the blocked condition and being aligned with the unblocked condition holding magnet when the blocking member is in the unblocked condition; and a second alignment magnet being aligned with the blocked condition holding magnet when the blocking member is in the blocked condition and being aligned with the intermediate holding magnet when the blocking member is in the unblocked condition.

* * * * *